US011260255B2

(12) United States Patent
Short et al.

(10) Patent No.: US 11,260,255 B2
(45) Date of Patent: Mar. 1, 2022

(54) FEPS (FLEXION EXTENSION PRONATION SUPINATION) DEVICES AND METHODS OF USE

(71) Applicant: Karma Machining & Manufacturing Ltd., Edmonton (CA)

(72) Inventors: Darryl Short, Edmonton (CA); David Dejong, Edmonton (CA); Sarah Lees-Miller, Edmonton (CA)

(73) Assignee: Karma Machining & Manufacturing Ltd., Edmonton (CA)

( * ) Notice: Subject to any disclaimer, the term of this patent is extended or adjusted under 35 U.S.C. 154(b) by 115 days.

(21) Appl. No.: 15/647,153

(22) Filed: Jul. 11, 2017

(65) Prior Publication Data

US 2019/0015693 A1 Jan. 17, 2019

(51) Int. Cl.

| | |
|---|---|
| ***A63B 21/00*** | (2006.01) |
| ***A63B 21/22*** | (2006.01) |
| ***A63B 23/035*** | (2006.01) |
| ***A63B 23/12*** | (2006.01) |
| ***A63B 1/00*** | (2006.01) |

(52) U.S. Cl.

CPC ..... *A63B 21/00192* (2013.01); *A63B 1/00* (2013.01); *A63B 21/22* (2013.01); *A63B 21/4035* (2015.10); *A63B 23/03525* (2013.01); *A63B 23/12* (2013.01); *A63B 2209/08* (2013.01); *A63B 2225/055* (2013.01)

(58) Field of Classification Search

CPC ..... A63B 21/001; A63B 23/12; A63B 21/40; A63B 21/22; A63B 23/035; A63B 2209/08; A63B 2225/055

See application file for complete search history.

(56) References Cited

U.S. PATENT DOCUMENTS 3,211,453 A * 10/1965 Williams ..... A63B 23/14 482/46
3,622,153 A * 11/1971 Thompson ..... A63B 22/001 482/60
3,649,008 A * 3/1972 Zinken ..... A63B 23/14 482/46
3,717,338 A * 2/1973 Hughes ..... A63B 23/14 482/46
3,758,111 A * 9/1973 Agamian ..... A63B 22/0694 482/57
3,848,870 A * 11/1974 Craig ..... A63B 21/023 108/140
3,880,153 A * 4/1975 Perrine ..... A61H 23/00 601/101
3,910,571 A * 10/1975 Stenn ..... A63B 22/0605 482/60

(Continued)

*Primary Examiner* — Garrett K Atkinson

(74) *Attorney, Agent, or Firm* — CPST Intellectual Property Inc.; Santosh K. Chari

(57) ABSTRACT

A FEPS (flexion extension pronation supination) device includes: a structural frame; a shaft mounted to rotate relative to the structure frame; and a brake that is structured to apply a selectively variable resistance against rotation of the shaft relative to the structural frame. A FEPS (flexion extension pronation supination) device includes: a structural frame; a shaft mounted to rotate relative to the structure frame; and a gripping member mounted to the structural frame and structured to adhere to an external support surface. A method includes operating the FEPS device by rotating the shaft.

19 Claims, 14 Drawing Sheets

(56) References Cited

U.S. PATENT DOCUMENTS 3,966,201 A * 6/1976 Mester ..... A63B 23/0355 482/72
4,165,070 A * 8/1979 Rice ..... A63B 23/03533 482/139
4,203,591 A * 5/1980 Gibson ..... A63B 21/012 482/46
4,265,447 A * 5/1981 Shafer ..... A47B 31/06 108/44
4,471,957 A * 9/1984 Engalitcheff, Jr. .. A63B 21/015 434/219
4,643,417 A * 2/1987 Nieman ..... A63B 21/015 482/46
4,765,315 A * 8/1988 Krukowski ..... A63B 21/0056 482/5
4,863,157 A * 9/1989 Mendel ..... A61N 1/36003 482/62
4,869,491 A * 9/1989 Nolan ..... A63B 23/03533 482/45
4,925,184 A * 5/1990 McJunkin, Jr. .... A63B 22/0605 482/60
4,971,317 A * 11/1990 Link ..... A63B 22/0694 472/128
4,973,046 A * 11/1990 Maxwell ..... A63B 21/00178 482/60
5,027,794 A * 7/1991 Pyle ..... A63B 21/00181 482/119
5,087,031 A * 2/1992 Hoff ..... A63B 23/129 482/46
5,108,092 A * 4/1992 Hurst ..... A63B 22/0005 482/60
5,244,442 A * 9/1993 Schill ..... A63B 21/015 482/114
5,460,585 A * 10/1995 Gentry ..... A63B 21/0056 482/1
6,071,214 A * 6/2000 Osterman ..... A63B 23/14 482/44
6,117,093 A * 9/2000 Carlson ..... A63B 21/0056 482/4
6,623,406 B2 * 9/2003 Wu ..... A63B 22/0664 482/51
7,160,231 B2 * 1/2007 Kazemi ..... A63B 22/0056 482/60
7,618,354 B2 * 11/2009 Wu ..... A63B 21/015 482/52
7,625,318 B1 * 12/2009 Heyn ..... A63B 21/4013 482/100
7,637,854 B2 * 12/2009 Jang ..... A61H 1/0222 482/142
7,883,453 B1 * 2/2011 Cooper ..... A63B 23/0211 482/140
D637,664 S * 5/2011 Battison ..... A63B 21/012 D21/663
D681,136 S * 4/2013 Liu ..... D21/663
9,168,418 B2 * 10/2015 Adamchick ..... A63B 71/0622
10,112,067 B2 * 10/2018 Golesh ..... A63B 21/0125
10,207,138 B2 * 2/2019 Hsu ..... A63B 21/00845
10,646,748 B1 * 5/2020 Bernotas ..... A63B 21/00069
2003/0092536 A1 * 5/2003 Romanelli ..... A61H 1/0214 482/60
2010/0160119 A1 * 6/2010 O'Connor ..... A63B 23/14 482/45
2013/0172155 A1 * 7/2013 Adamchick ..... G06Q 50/22 482/8
2018/0036572 A1 * 2/2018 Hsu ..... F16F 9/535

* cited by examiner

Fig. 11
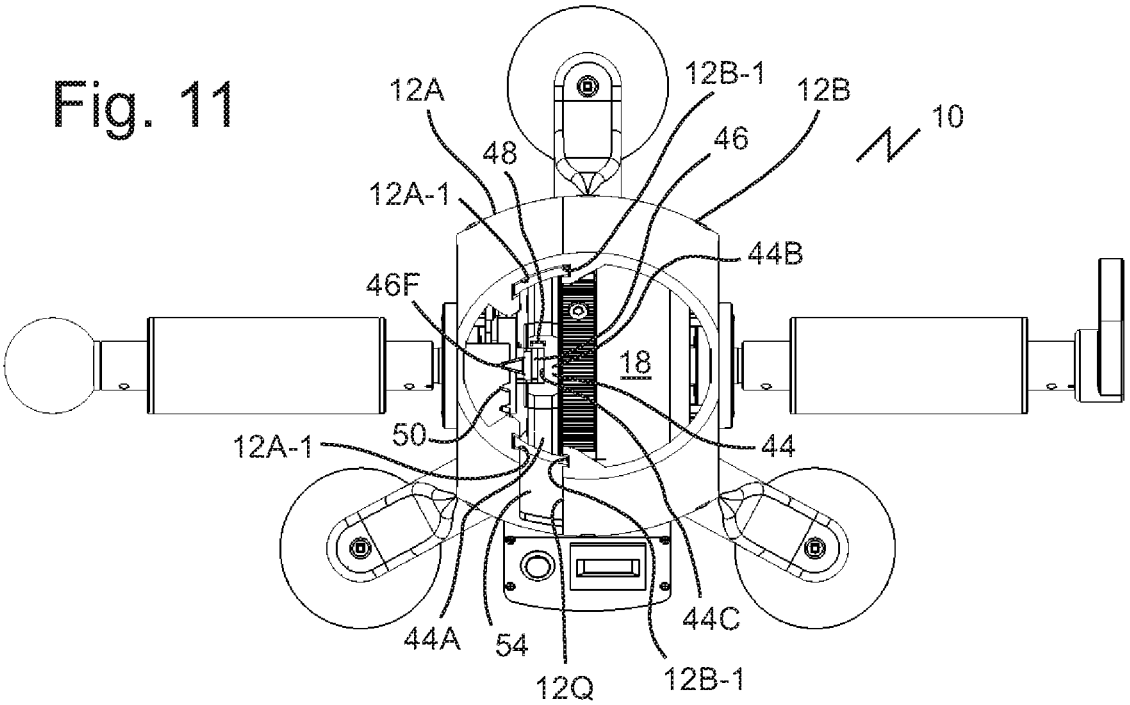
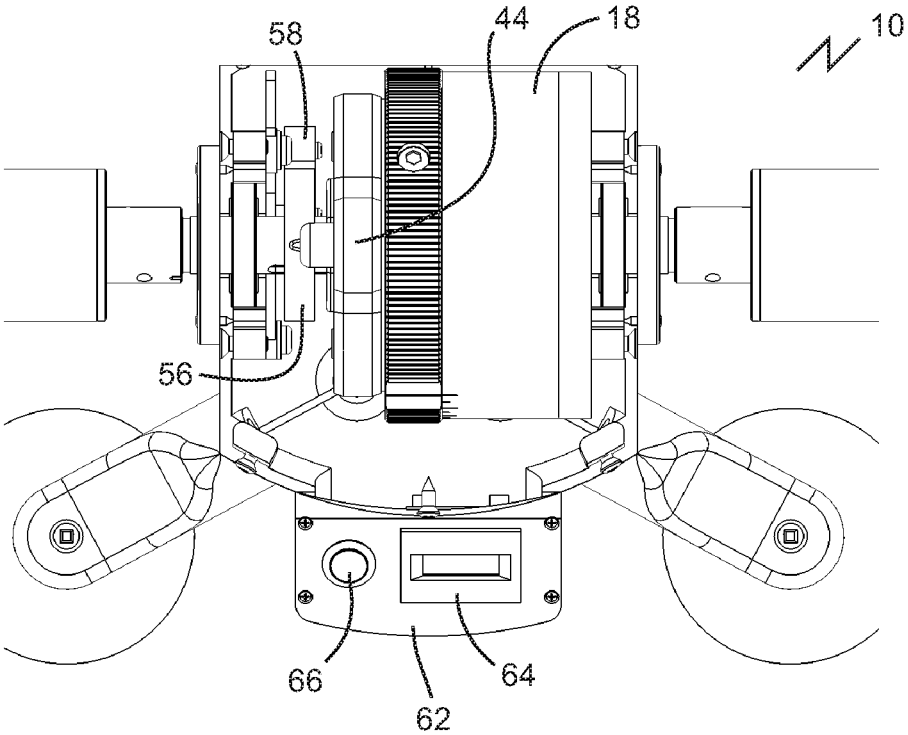
Fig. 12

FEPS (FLEXION EXTENSION PRONATION SUPINATION) DEVICES AND METHODS OF USE

TECHNICAL FIELD

This document relates to FEPS devices and methods of use.

BACKGROUND

FEPS devices are used to rehabilitate and strengthen the wrists, hands, and forearms. Existing devices use a shaft that rotates under selectively variable resistance.

SUMMARY

A FEPS (flexion extension pronation supination) device is disclosed comprising: a structural frame; a shaft mounted to rotate relative to the structure frame; and a brake that is structured to apply a selectively variable resistance against rotation of the shaft relative to the structural frame.

A FEPS (flexion extension pronation supination) device is disclosed comprising: a structural frame; a shaft mounted to rotate relative to the structure frame; and a gripping member mounted to the structural frame and structured to adhere to an external support surface.

A method is disclosed comprising operating the FEPS device by rotating the shaft.

A FEPS (flexion extension pronation supination) device is disclosed comprising: a structural frame; a shaft mounted to rotate relative to the structure frame; and a magnetic hysteresis brake that is structured to apply a selectively variable resistance against rotation of the shaft relative to the structural frame.

A FEPS (flexion extension pronation supination) device is disclosed comprising: a structural frame; a shaft mounted to rotate relative to the structure frame; and a brake that is structured to apply a selectively variable resistance against rotation of the shaft relative to the structural frame.

In various embodiments, there may be included any one or more of the following features: The gripping member comprises a plurality of external-support-surface-gripping feet. The gripping member comprises three external-support-surface-gripping feet. The gripping member comprises a suction cup. A brake that is structured to apply a selectively variable resistance against rotation of the shaft relative to the structural frame. The brake comprises a magnetic hysteresis brake. A resistance adjuster lever connected to manipulate the brake. The structural frame defines a plurality of teeth oriented about a range of motion of the resistance adjuster lever to selectively engage and disengage a corresponding tooth or indent on the resistance adjuster lever to set the brake at a desired resistance level. The resistance adjuster lever comprises an actuator connected to selectively disengage the corresponding tooth or indent with the plurality of teeth to permit the resistance adjuster lever to be moved into a different position about the range of motion. The structural frame comprises a top shroud that encloses the brake and part of the shaft. A handle connected to an end of the shaft. A plurality of handles, each handle being distinct from one another and being configured to interchangeably connect to the end of the shaft. The plurality of handles include a key, a door knob, and a door handle lever. The plurality of handles comprises: a plurality of handle shafts, each handle shaft being distinct from one another and being configured to interchangeably connect to the end of the shaft; and a plurality of handle tips, each handle tip being distinct from one another and being configured to interchangeably connect to an end of a respective handle shaft. A repetition counter. The repetition counter comprises a shaft encoder. The repetition counter comprises a switch arm mounted to follow an outer profile of a cam mounted to the shaft. The cam comprises a ring plate with an out of round convex cross-sectional profile. The gripping member is mounted to the external support surface, which forms part of a piece of furniture. A gripping member mounted to the structural frame and structured to adhere to an external support surface. The gripping member depends below a base of the structural frame. The brake comprises an electromagnetic brake. The handle comprises a first handle connected to a first end of the shaft, and a second handle connected to a second end of the shaft.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 11 is a section view taken along the 11-11 section lines from FIG. 2.

FIG. 12 is a cutaway top plan view of the FEPS device of FIG. 1.

DETAILED DESCRIPTION

Figure 1:
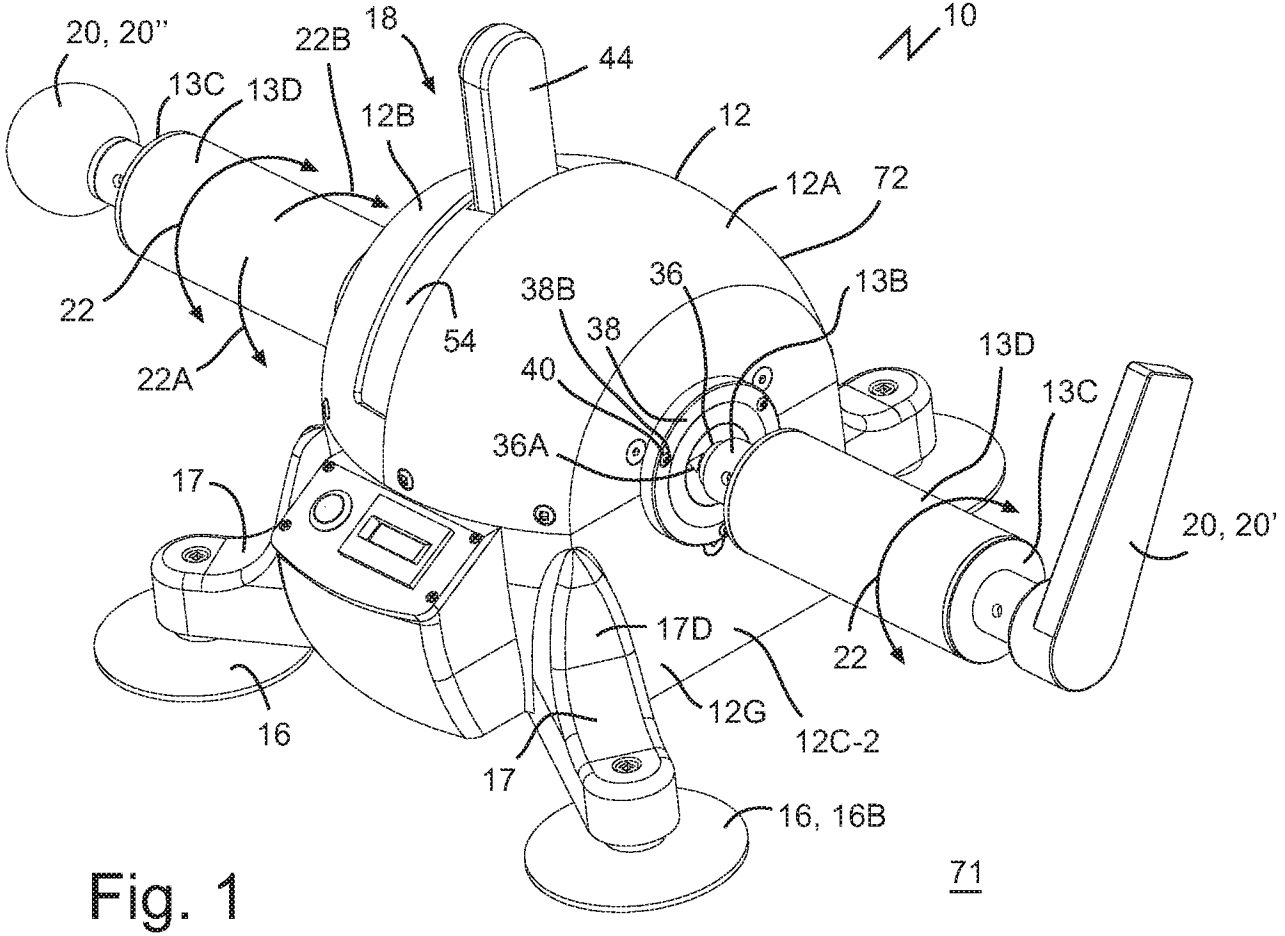
FIG. 1 is a perspective view of a FEPS (flexion extension pronation supination) device.
Figure 2:
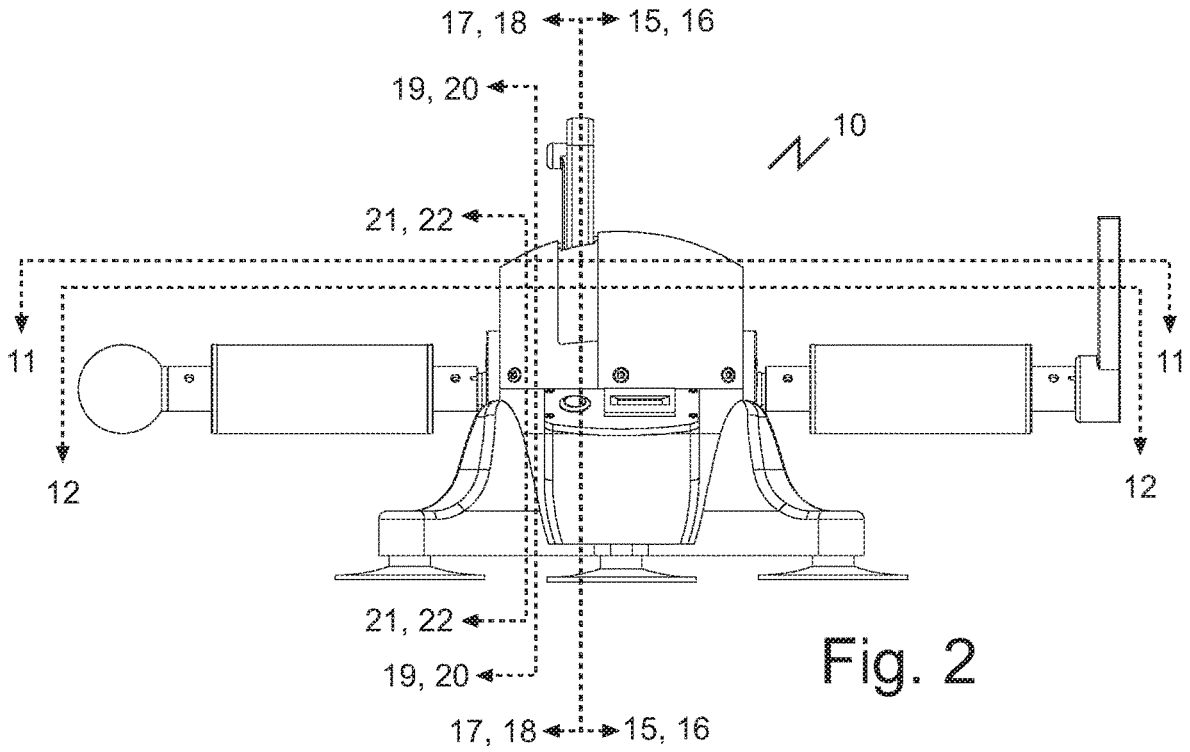
FIG. 2 is a front side elevation view of the FEPS device of FIG. 1.
Figure 3:
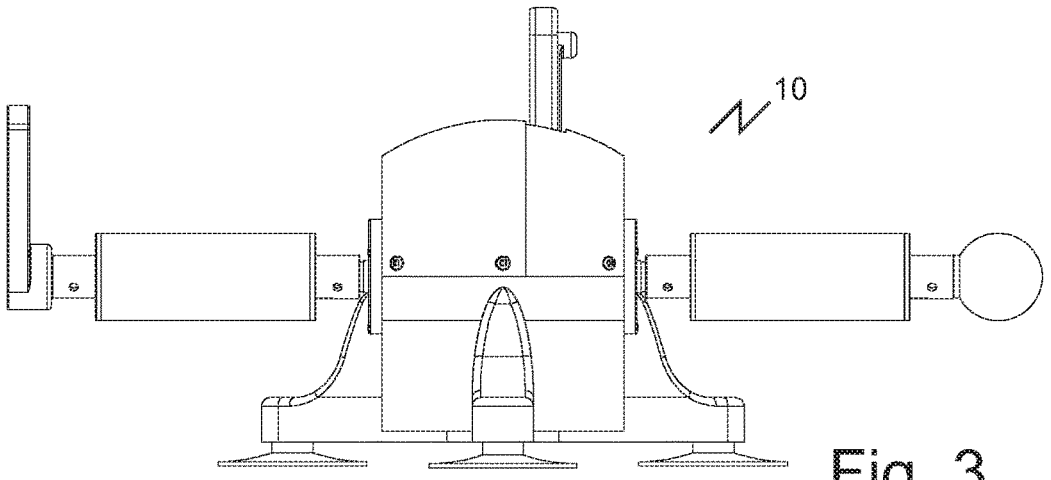
FIG. 3 is a rear side elevation view of the FEPS device of FIG. 1.
Figure 4:
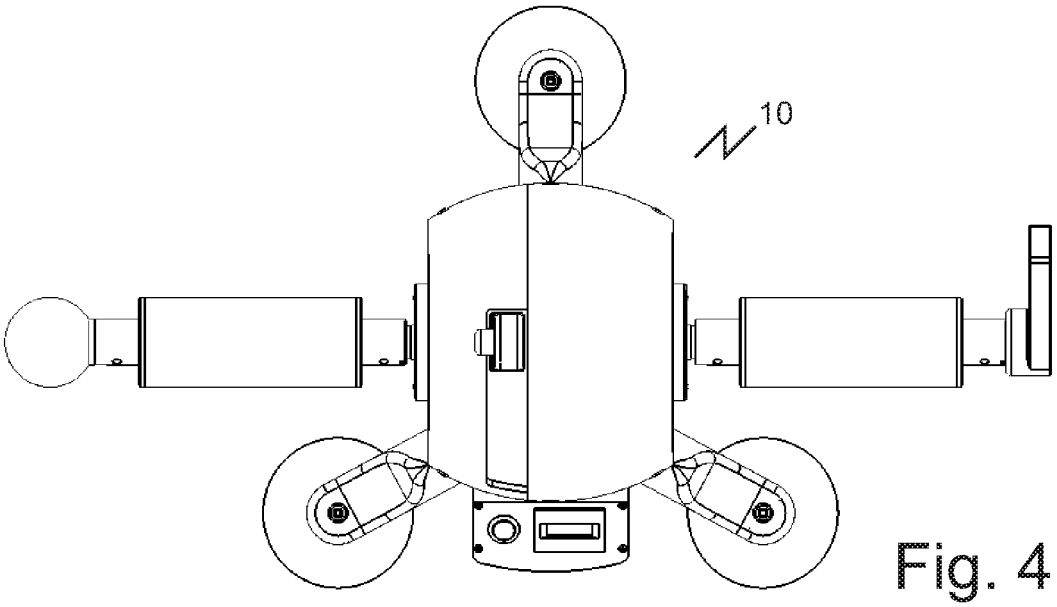
FIG. 4 is a top plan view of the FEPS device of FIG. 1.

Immaterial modifications may be made to the embodiments described here without departing from what is covered by the claims.

Hand, wrists, and arms may be injured in various ways. Typical injuries range from minor sprains and bruises to major fractures, partial paralysis, burns, and deformation. Included in these are injuries or diseases of the spinal cord that affect movement of these extremities. Because of the anatomical complexity of the wrist area, rehabilitation of the forearm, hand and wrist are often lengthy and must be carefully monitored.

The human wrist is a relatively complex structure, and damage to the wrist can result in injuries that are difficult and time consuming to heal. Traditionally, the injured wrist is immobilized to permit the joining of broken bones and torn tendons, as well as to allow the healing of inflamed tendons. After the structure has healed, it can be difficult to redevelop full muscular strength and flexibility in the wrist, as the muscles and tendons tend to atrophy to a certain degree due to the immobilization.

Accordingly, therapists assist a patient to exercise the wrist, gradually building up the strength and mobility of the joint until optimum strength and mobility have been reached. Such therapy is costly due to the specialized equipment often used, as well as the cost of usually personalized therapy provided by a specialist. Various specialized machines and equipment have been developed in the past for the purpose of providing some form of therapy to the wrist, but most require active muscular input from the user, and the development of muscular strength for such input does not necessarily provide the flexibility needed, as it is important that the muscular structure be stretched gradually, as well as that the muscles be made to contract to develop strength.

Passive therapeutic wrist rotators exist to rehabilitate the wrist and to bring it back to substantially full strength and flexibility. A user of such devices need only grip the handgrip handle, turn on a switch, and allow the active rotational means of the device to rotate the wrist passively, without any muscular effort on the part of the user, other than gripping the handgrip.

Active devices exist to train bilateral, cooperative hand functions of a subject with housing means, handle means comprising two exchangeable handles, namely a left handle and a right handle. Shaft means comprise multiple shafts and couplings for coupling said shafts. Clutching means comprise variable slipping clutches, with the slipping clutches being adjustable. First sensor means are provided for measuring the angular position of each of said handles, and second sensor means are provided for measuring the torque which is applied by the subject onto each of said handles. Locking means are provided for locking said shaft means wherein both handles can be rotated independently when said locking means are locked. The locking means are positioned between the second sensor means so that the second sensor means for the left handle can measure the torque applied onto the left handle and the second sensor means for the right handle can measure the torque applied onto the right handle.

Forearm and wrist exercise devices are known to include a base frame, a handle rod, a driver wheel, a driven yoke, a driven wheel and an adjustable tensioner. The base frame is attached to a stationary object, such as a wall. The handle rod extends from the driver wheel and the handle rod is pivotally retained by the base frame. One end of the driven yoke is pivotally retained by the base frame and the driven wheel is pivotally retained by the other end thereof. The driven wheel is forced against the driver wheel with the adjustable tensioner. A hydraulic pump, a hydraulic flow valve and a pair of extension shafts may be present to adjust tension.

Figure 8:
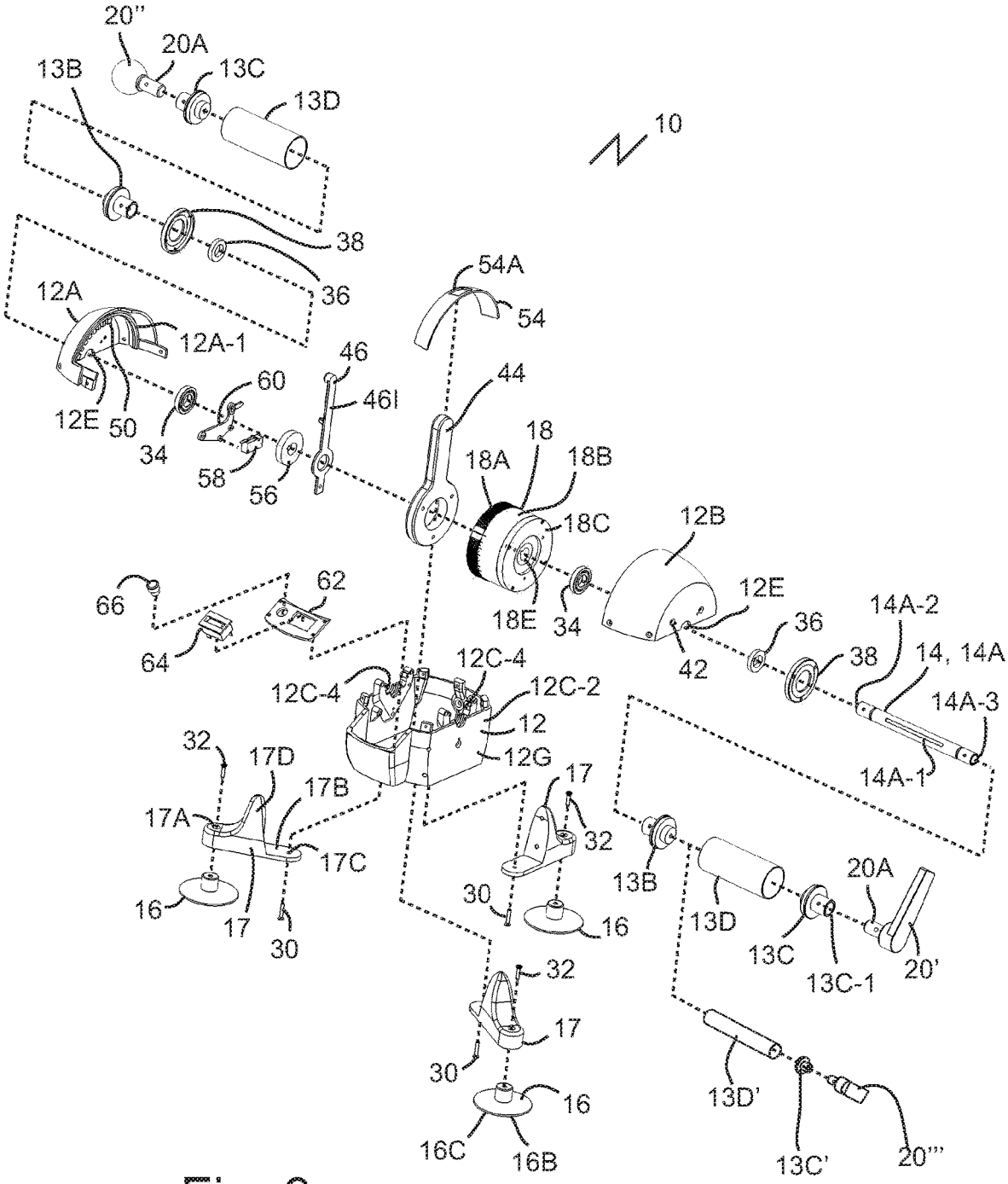
FIG. 8 is an exploded perspective view of the FEPS device of FIG. 1.

Referring to FIGS. 1 and 8-10, a FEPS (flexion extension pronation supination) device 10 is illustrated comprising a structural frame 12 and a rotatable shaft 14. Referring to FIG. 1, the FEPS device 10 may comprise a gripping member 16, for example mounted to the structural frame 12 and structured to adhere to an external support surface 71. The support surface 71 may face and support the FEPS device 10 in use. Referring to FIG. 8, the gripping member 16 may comprise a plurality of external-support-surface-gripping feet 16B. Referring to FIG. 1, in use the gripping member 16 may be mounted to an external support surface 71, which forms part of a piece of furniture, for example a table or counter top. The FEPS device 10 may be operated by rotating a shaft 14, for example in directions 22.

Figure 5:
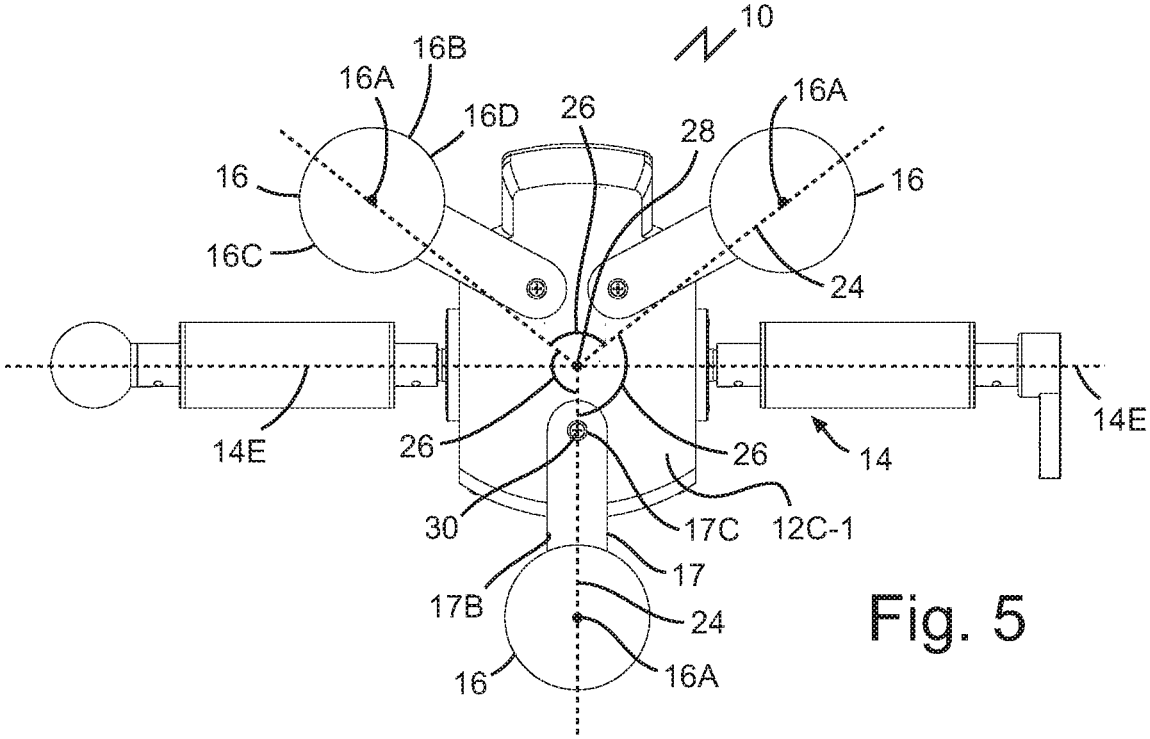
FIG. 5 is a bottom plan view of the FEPS device of FIG. 1.
Figure 6:
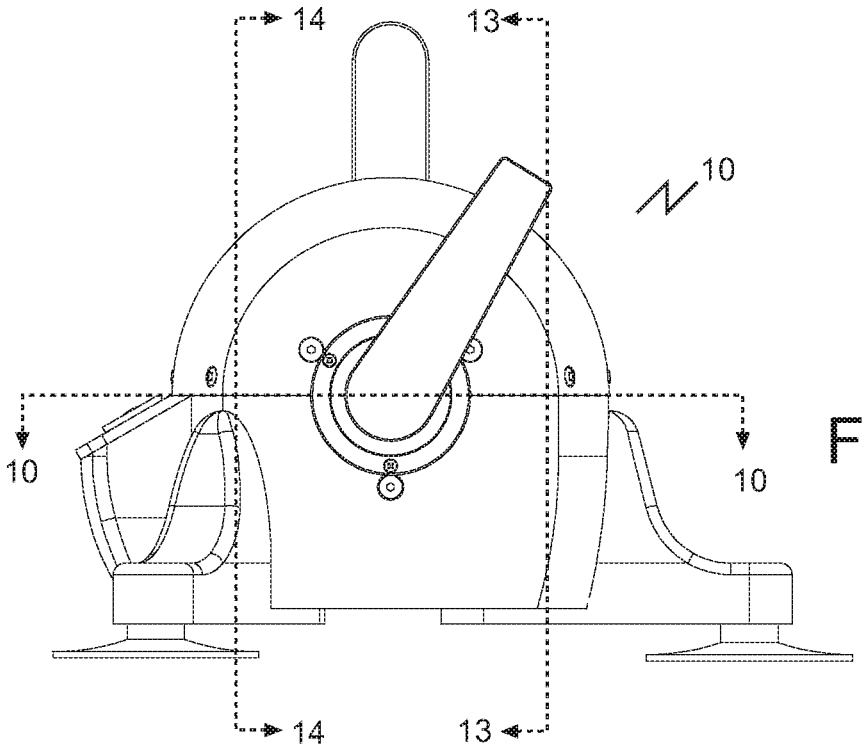
FIG. 6 is a first end view of the FEPS device of FIG. 1.
Figure 7:
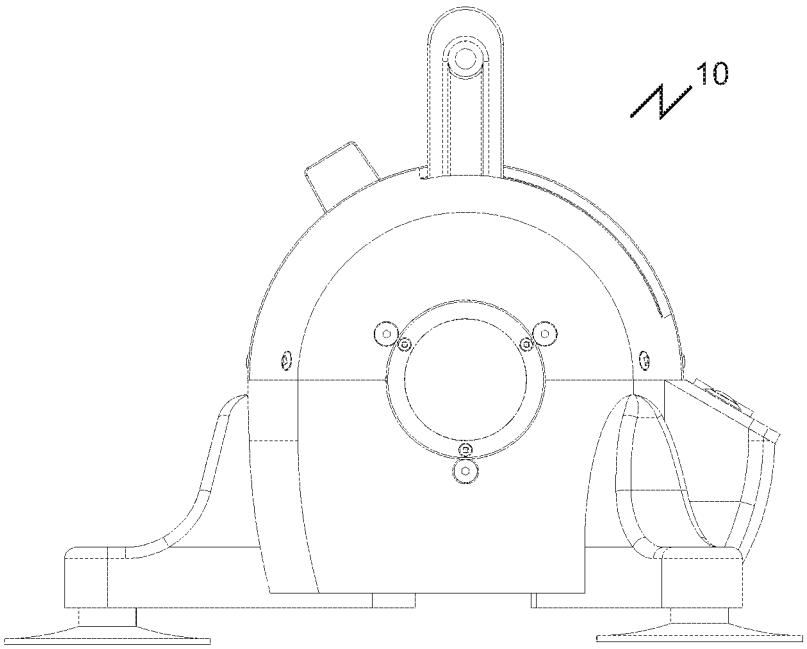
FIG. 7 is a second end view of the FEPS device of FIG. 1.

Referring to FIG. 1, the gripping member 16 may have a structure suitable for adhering to the external support surface 71. Referring to FIG. 8, the gripping member 16 may comprise one or more suction cups. Referring to FIGS. 1 and 8, suction cups 16C may use the negative fluid pressure of air to adhere to the external support surface 71 (FIG. 1) via a partial vacuum. Referring to FIGS. 1 and 5, the suction cup 16C may be made of elastic or other suitable material and may have a curved surface, for example that is configured such that when a center 16A of the gripping member 16 is pressed against the external support surface 71 (FIG. 1), the volume of the space between the external support surface 71 is reduced causing the air between the suction cup 16C and the external support surface 71 to be expelled past a peripheral rim of the suction cup 16C. The cavity that develops between the cup 16C and the flat surface 71 may have little to no air in it. The pressure difference between the atmosphere on the outside of the suction cup 16C and the low-pressure cavity on the inside of the suction cup 16C may keep the gripping member 16 adhered to the external support surface 71. A lever (not shown) or other type of suction release mechanism may be connected to release the suction on each cup 16C. Other mechanisms may be used to adhere the members 16 to an external support surface other than or in addition to suction cups, such as via magnets or hook and loop fasteners. Such other mechanisms include non-destructive adherence to a planar external support surface.

Referring to FIG. 1, the gripping member 16 may have a structure suitable for balancing the FEPS device 10 on the external support surface 71 to avoid the FEPS device 10 from tipping over during use. The gripping member 16 may comprise three external-support-surface-gripping feet 16B. Referring to FIG. 5, each external-support-surface-gripping feet 16B may be spaced from a vertical plane defined by a shaft axis 14E, for example with two external-support-surface-gripping feet 16B positioned on one side of the vertical plane and one external-support-surface-gripping foot 16B positioned on the other side of the vertical plane to form a stable tripod configuration with lateral support. Respective centers 16A of the external-support-surface-gripping feet 16B may be positioned along radial lines 24 that extend from a vertical central axis 28, defined by the structural frame 12 and the shaft axis 14E. Radial lines 24 may form suitable angles such as 120 degrees between adjacent radial lines 24. Other angles, including unequal angles, may be formed between adjacent lines 24 and respective feet 16B.

Figure 9:
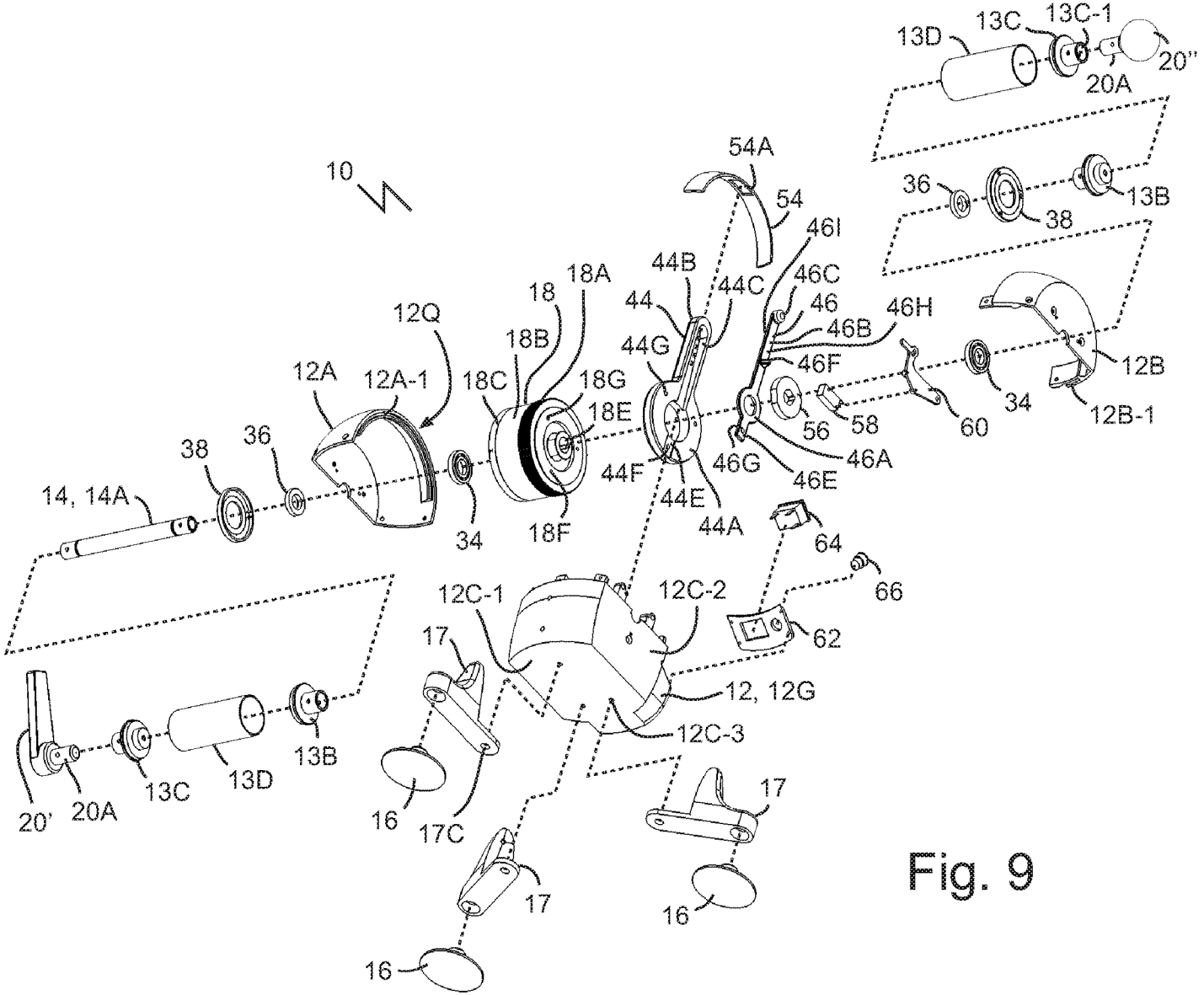
FIG. 9 is an exploded perspective view of the FEPS device of FIG. 1.
Figure 10:
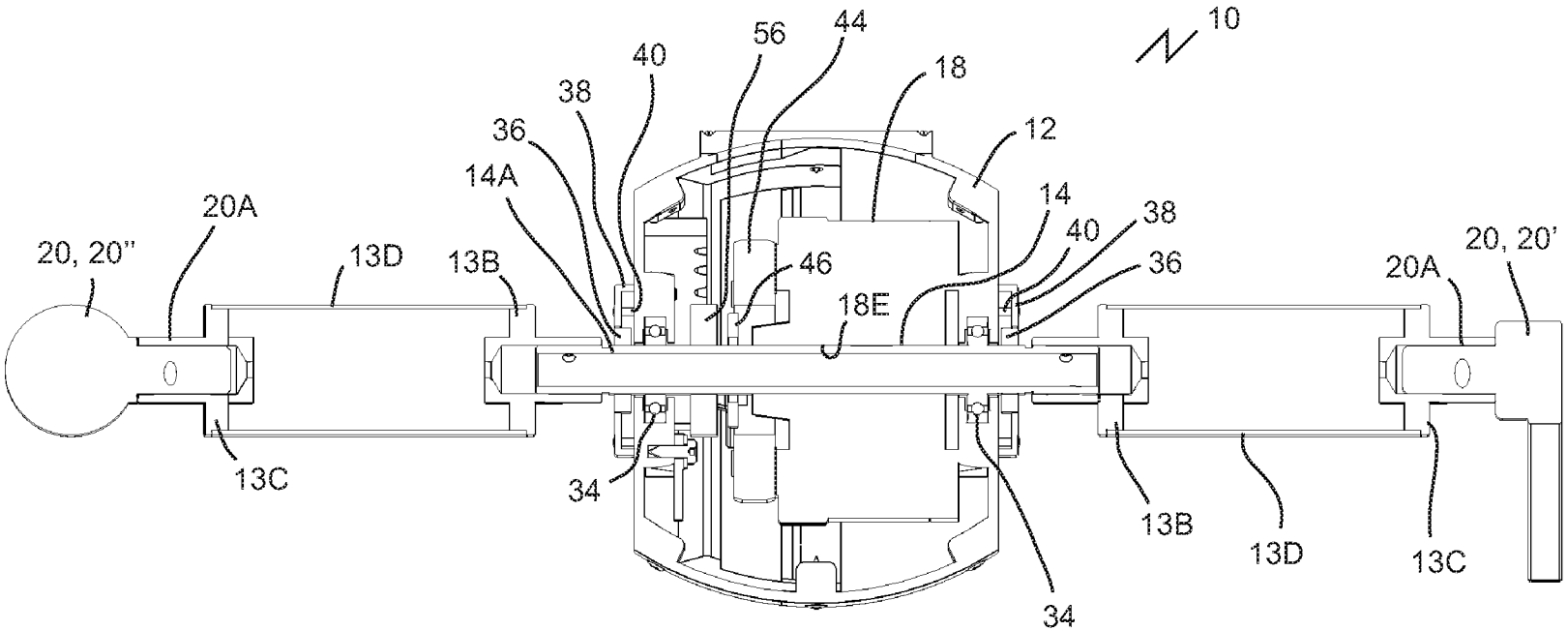
FIG. 10 is a section view taken along the 10-10 section lines from FIG. 6.
Figure 13:
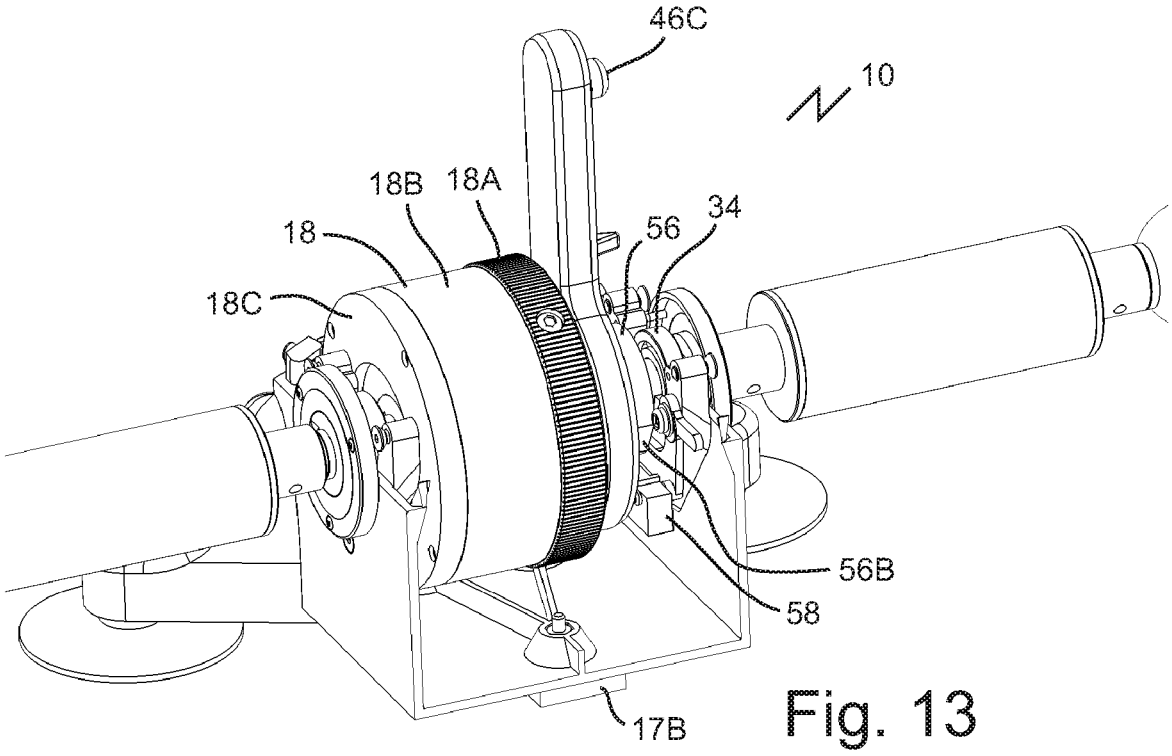
FIG. 13 is a perspective section view taken along the 13-13 section lines from FIG. 6.

Referring to FIG. 8, the external-support-surface-gripping feet 16B may connect to the structural frame 12 via a suitable structure, for example respective legs 17. The external-support-surface-gripping feet 16B may connect to the legs 17 via a suitable mechanism such as respective fasteners 32 and holes 17A. Legs 17 may connect to structural frame 12 via respective lateral anchor arms 17B and respective shoulders 17D. Referring to FIGS. 8 and 9, the lateral anchor arms 17B may connect to the structural frame 12 via one or more of respective holes 17C, respective fasteners 30, and respective aligned holes 12C-3 in structural frame 12 (FIG. 9). The arm-holes 17C and underside-holes 12C-3 may be positioned to align with one another and concurrently receive the arm-fasteners 30. Shoulders 17D may be formed of upright members that hug the side walls of a base 12G of frame 12.

Referring to FIGS. 1 and 8-10, the structural frame 12 may have a configuration suitable for mounting and enclosing part or all of the operative machinery of the FEPS device 10. The frame 12 may define a housing. Referring to FIGS. 1 and 9, the structural frame 12 may comprise a frame-base 12G and a top shroud 72 (FIG. 1). Referring to FIG. 9, the frame-base 12G may have an underside 12C-1 and an external side wall surface 12C-2 connected to a perimeter of the underside 12C-1. Referring to FIG. 8, the external side wall surface 12C-2 may have one or more bearing saddles or slots 12C-4, for example shaped to receive one or more respective bearings 34 and/or the shaft 14. The shaft 14 may be positioned within bearings 34, for example to constrain movement of the shaft 14 and reduce friction arising from rotation of the shaft 14. Referring to FIGS. 1 and 8, the top shroud 72 (FIG. 1) may be formed by a left shroud 12A and a right shroud 12B, for example that connect to one another and are mounted to the external side wall surface 12C-2. The left and right shrouds 12A and 12B may define respective shaft holes 12E, for example shaped to receive and/or surround the shaft 14 in conjunction with the slots 12C-4. The axial bore holes 12E and slots 12C-4 may have a semi-circular configuration or other suitable shape. Together, the top shroud 72 and the frame-base 12G may form an enclosure that surrounds a part of the shaft 14 or other suitable such as a brake 18 as discussed below.

Referring to FIGS. 8-14, the FEPS device 10 may comprise a brake 18, for example that is structured to apply a selectively variable resistance against rotation of the shaft 14 relative to the structural frame 12. Brake 18 may comprise a magnetic hysteresis brake, a disc brake, an eddy current brake, or other suitable brake. Brakes with an electromagnet or permanent magnet may facilitate accurate engagement and clean release, in some cases without creating friction between parts other than through bearing connections. Such brakes may also run cooler and cleaner, with the convenience and controllability of electrical components.

In hysteresis clutches and brakes, hysteresis losses transmit constant torque for a given current. Used mostly in fractional power applications, such may exhibit almost no wear. Such brake units may comprise a fixed magnetic pole assembly and a moving drag cup, which constitutes a rotor. The rotor is suspended by shaft bearings into a close-tolerance groove in the assembly, and current applied to a coil in the pole structure creates a magnetic field in the groove. As the rotor turns, its magnetic particles do a constant flip-flopping in an attempt to stay magnetically aligned with the groove's field. Braking resistance results from the hysteresis heat losses resulting from the molecular friction in the pole and rotor. A coil on the pole assembly generates a magnetic field in the assembly and drag cup. Hysteresis losses in the cup cause the flux to change more slowly than through the assembly, which transmits smooth torque through the drag cup. Though a slight eddy current effect is always present, full rated torque is independent of slip speed, the relative speed between rotor and pole assembly.

During normal operation the rotor's magnetic orientation is constantly realigned by its rotation and by coil current changes; this dynamic operation results in smooth transitions between torque levels for coil power adjustments. When electricity is applied to the field, it creates an internal magnetic flux. That flux is then transferred into a hysteresis disk passing through the field. The hysteresis disk is attached to the brake shaft. A magnetic drag on the hysteresis disk allows for a constant drag, or eventual stoppage of the output shaft. When electricity is removed from the brake, the hysteresis disk is free to turn, and no relative force is transmitted between either member. Therefore, the only torque seen between the input and the output may be bearing drag. In applications where electrical power cannot be supplied to a clutch or brake coil, or where it is otherwise desired not to use electrical power, permanent magnets may be used to provide hysteresis braking. Permanent magnets are of hard magnetic materials, such as rare earth magnets, with domains that stay in an aligned orientation, even in magnetic fields. By manually moving such magnets, the amount of magnetism acting on a brake's output rotor may be adjusted.

Figure 14:
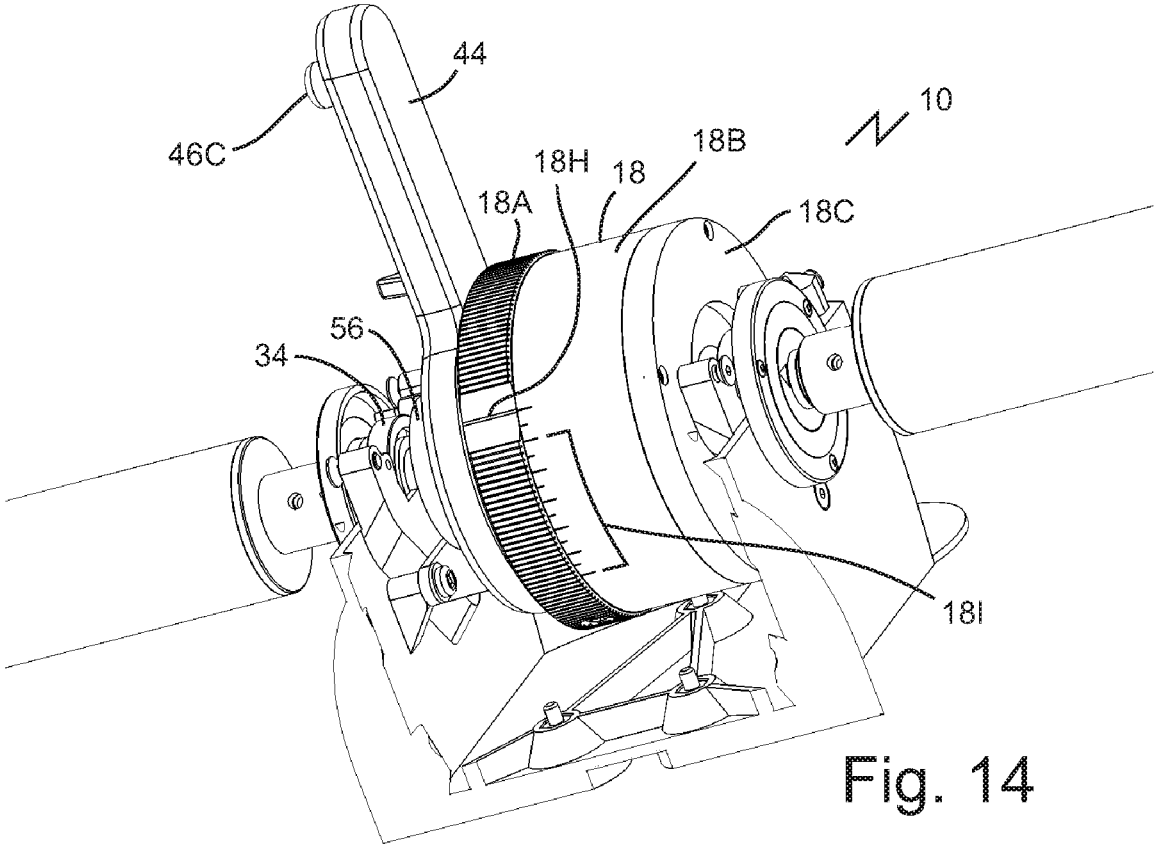
FIG. 14 is a perspective section view taken along the 14-14 section lines from FIG. 6.
Figure 15:
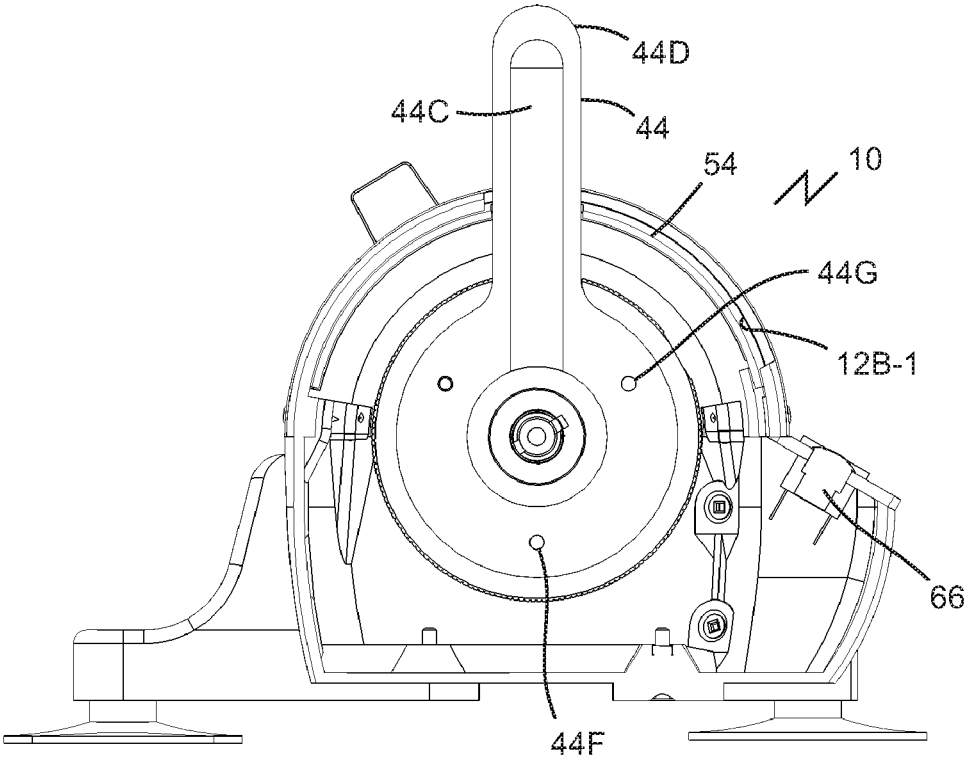
FIG. 15 is a section view taken along the 15-15 section lines from FIG. 2.
Figure 23:
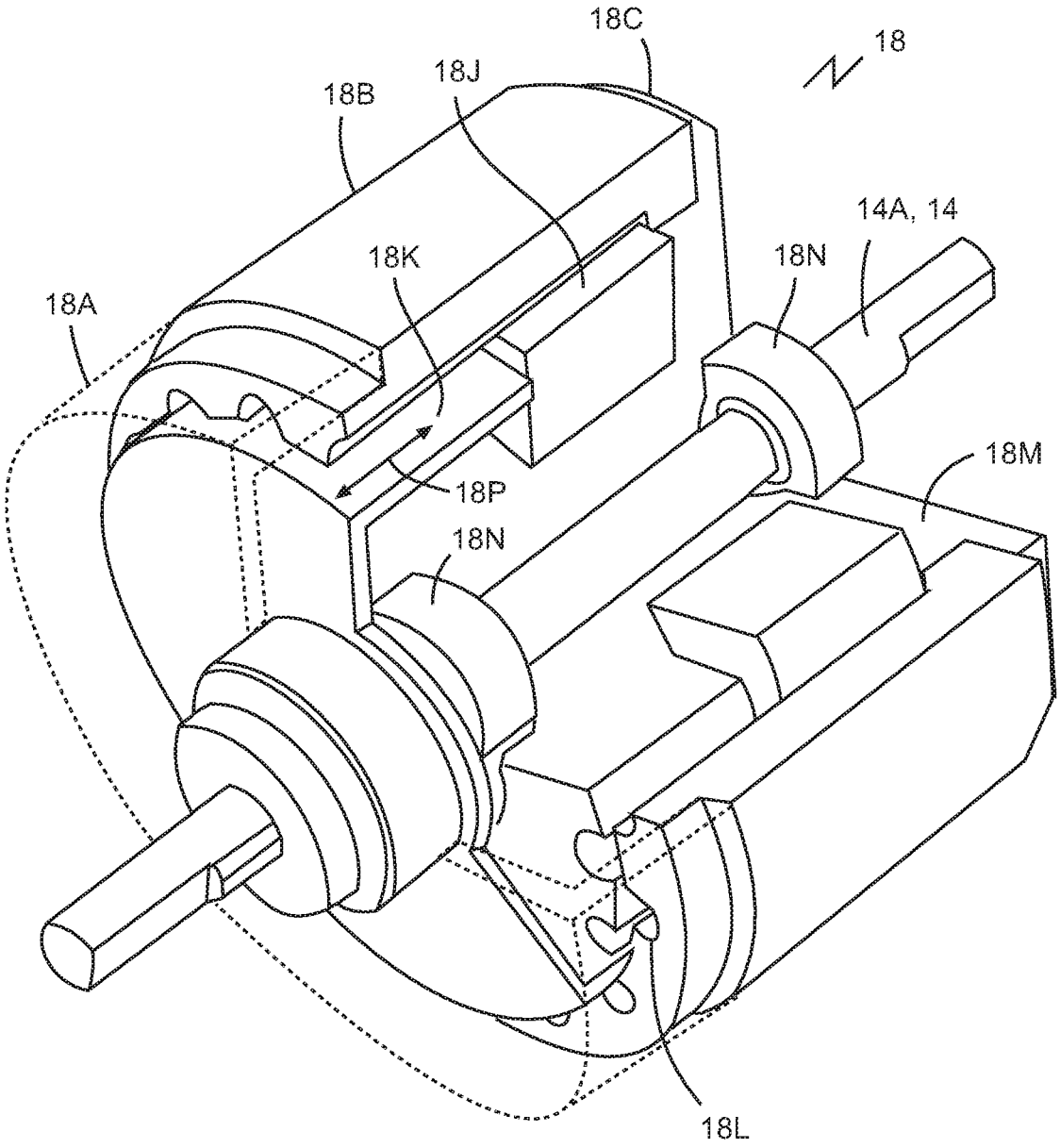
FIG. 23 is a cutaway perspective view of a magnetic hysteresis brake for use in the FEPS device of FIG. 1.

Referring to FIGS. 8, 14, and 23, a magnetic hysteresis brake 18 may comprise a resistance ring 18A, a main body 18B that encloses a part of the shaft 14, and an end ring plate 18C. Referring to FIGS. 8 and 23, the resistance ring 18A and the end ring plate 18C may be connected to opposed ends of the main body 18B. Referring to FIG. 23, a reticulated pole structure 18M, a drag cup or rotor 18K, a field coil 18J, and bearings 18N may be provided as internal components of brake 18. An air gap 18L and a central bore 18E (FIG. 8), may be defined for example to receive the shaft 14. The rotor 18K and the shaft 14 may be connected to rotate together freely, relative to pole structure 18M, for example via a set screw or other suitable method, and shaft 14 may be mounted on bearings 18N of the brake 18 prior to energizing the field coil 18J or advancing the rotor 18K a sufficient distance in the case of a permanent magnet brake 18. When voltage or current is applied to the field coil 18J may produce magnetic lines of flux. Such flux may travel through the air gap 18L between the field coil 18J and the rotor 18K, such that the rotor 18K is magnetically restrained to provide a braking action between the pole structure 18M and rotor 18K with contact between such parts. The axial separation distance between the field coil 18J and the rotor 18K may be increased or decreased to decrease or increase the braking action, respectively. In cases where a permanent magnet is used, rotation of ring 18A may advance and retract rotor 18K to increase or decrease, respectively, the resistance applied to the shaft 14 by the brake 18.

Other brakes types may be used. Such other brakes may include magnetic particle brakes, eddy current brakes, mechanical brakes, and electromagnetic frictions brakes. In magnetic particle brakes, an output disc (attached to the output shaft) sits untouched inside a housing. Remaining empty space within the housing is filled with magnetic shavings or powder that remains free-flowing until acted on by a magnetic field radiating from a stationary coil, embedded in the housing. When the coil is energized with DC (direct current) power, the powder solidifies into chains along magnetic field lines, fixing the disc to the housing, and stopping the load.

Eddy current clutches are almost structurally identical to hysteresis clutches. However, the output discs that rotate through induced magnetic fields are made of nonferrous materials—good conductors that are otherwise only marginally magnetic. Materials include repelling diamagnetic aluminum, weakly attractive paramagnetic copper, and brass. During brake operation the rotor is made to rotate by a load. The stationary coil and pole assembly's polewheel are fixed to the stator body, attached to the main housing. When the magnetic flux penetrates the rotor, an attraction is created between the stationary polewheel and rotor. Because the rotor is fixed to the output shaft, this attraction causes the output shaft to slow, and braking is established.

A large number of electromagnetic brakes and clutches operate by friction. Such may use electrically created magnetism to clamp two friction faces together, thereby converting kinetic energy into thermal energy, which is then dissipated. An electromagnetic friction brake may have two principal components: an armature and a magnet. The armature is a steel plate or disc that is designed to rotate, it mounts to the shaft of the machine, and is the part clamped during braking.

Figure 16:
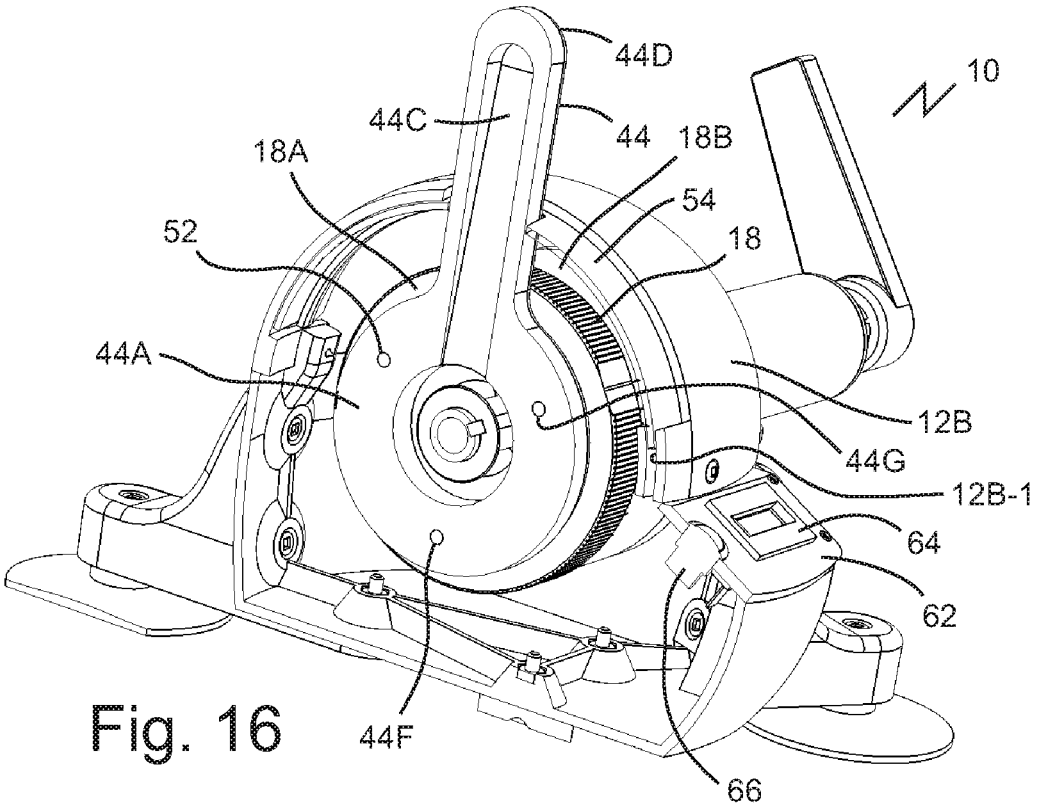
FIG. 16 is a perspective section view taken along the 16-16 section lines from FIG. 2.

Referring to FIGS. 8-9, 12, and 14, the FEPS device 10 may comprise a resistance adjuster, such as a lever 44, for example connected to manipulate the brake 18. Referring to FIG. 16, a part of lever 44, for example lever ring base 44A, may be connected to the resistance plate ring 18A to permit rotation of the ring 18A, relative to the main body 18B, in conjunction with rotation of lever 44. Referring to FIGS. 16 and 23, rotation of the resistance ring 18A may increase or decrease the axial separation distance between the rotor 18K and the field coil 18J (FIG. 23), for example by causing relative movement between same along axial direction lines 18P, and thus, change the level of resistance and braking action against rotation of the shaft 14.

Figure 17:
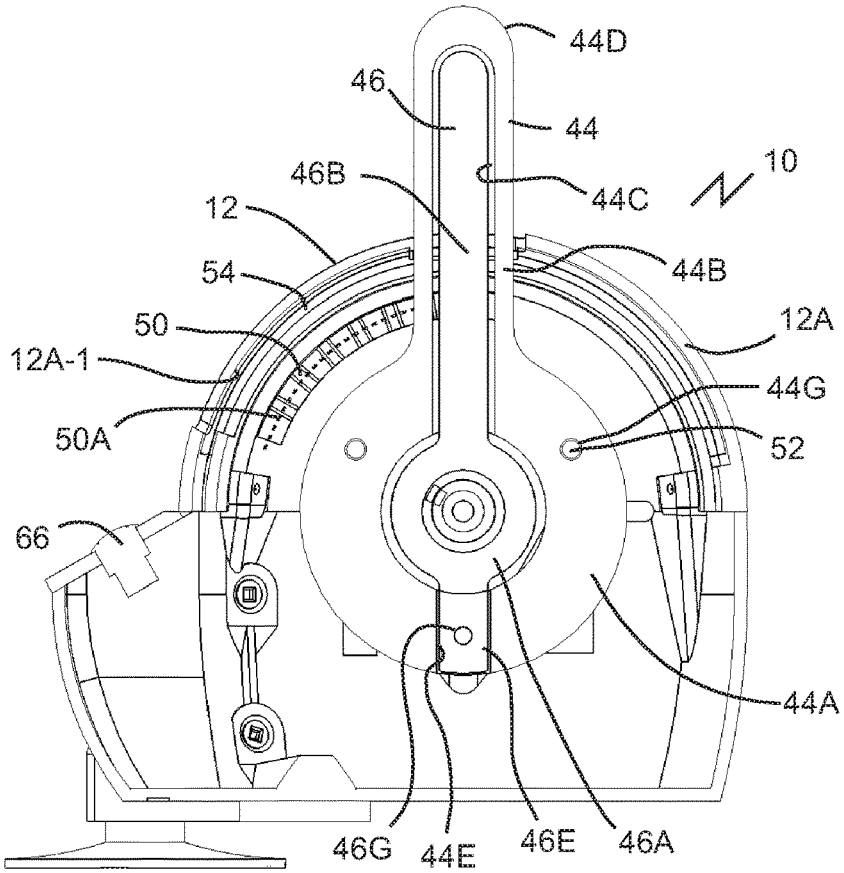
FIG. 17 is a section view taken along the 17-17 section lines from FIG. 2.

Lever 44 may have a structure suitable for mounting the lever 44 to the brake 18. Referring to FIGS. 9 and 16, lever 44 may have a lever-base-hole 44F positioned to align with a brake-base hole 18F in ring 18A, with one or more upper-handle-holes 44G positioned to align with upper-brake-holes 18G, all to receive respective fasteners 52 to secure parts together. Referring to FIGS. 9 and 17 fasteners 52 may pass into holes 44G and 18G to securely mount the lever 44 to the brake 18.

Referring to FIGS. 1, 11, and 16-20, the FEPS device 10 may have a structure suitable for incrementally adjusting the resistance level, regardless of whether the brake 18 permits adjustment across an infinite range of resistance levels. Referring to FIGS. 17-20, the structural frame 12 may define a plurality of teeth 50 oriented about a range of motion, such as an arcuate path 50A, of the lever 44 to selectively engage and disengage a corresponding indent, or tooth, such as locking-tooth 46F, on the lever 44 to set the brake 18 at a desired resistance level. The grooves may be shaped to mate with the locking-tooth 46F. The grooves and the locking-tooth 46F may have corresponding triangular shapes. The plurality of teeth 50 may be arranged to define a series of grooves as shown. The teeth 50 may provide a discrete number of locking positions and thus, a set number of levels of resistance.

Referring to FIGS. 9 and 13-20, the resistance adjuster lever 44 may comprise a suitable actuator, for example a lever lock 46 with a depressible button 46C, connected to selectively disengage the corresponding locking-tooth 46F with the plurality of teeth 50 to permit the lever 44 to be moved into a different position about the arcuate path 50A. Referring to FIGS. 8-9 and 15-18, the lever lock 46 may be structured to selectively engage and disengage the locking-tooth 46F in cooperation with lever 44. Lever lock 46 may have a lock-base ring 46A, a lock-arm 46B that extends from the lock-base ring 46A, and a base stem 46E, and may define an inner face 46H, and an opposed outer face 46I. Lever lock 46 may be structured to permit lock-arm 46B to be moved into an axial-facing groove 44C of the lever 44. Axial groove 44C may be tapered with increasing depth in a direction from the lock-base 46A to the lever lock tip 44D as illustrated in FIG. 16.

Referring to FIG. 9, the rear face 46I may face and be spaced from a surface of the axial groove 44C, and a base stem 46E of the lever lock 46 may be positioned within a base-groove 44E of the lever 44, when the lever lock 46 is mounted to the lever 44. Referring to FIG. 8, the depressible button 46C may be positioned at or near a lever lock tip 44D. The lever lock 46 may be positioned such that the project outward away from the lever 44.

Figure 18:
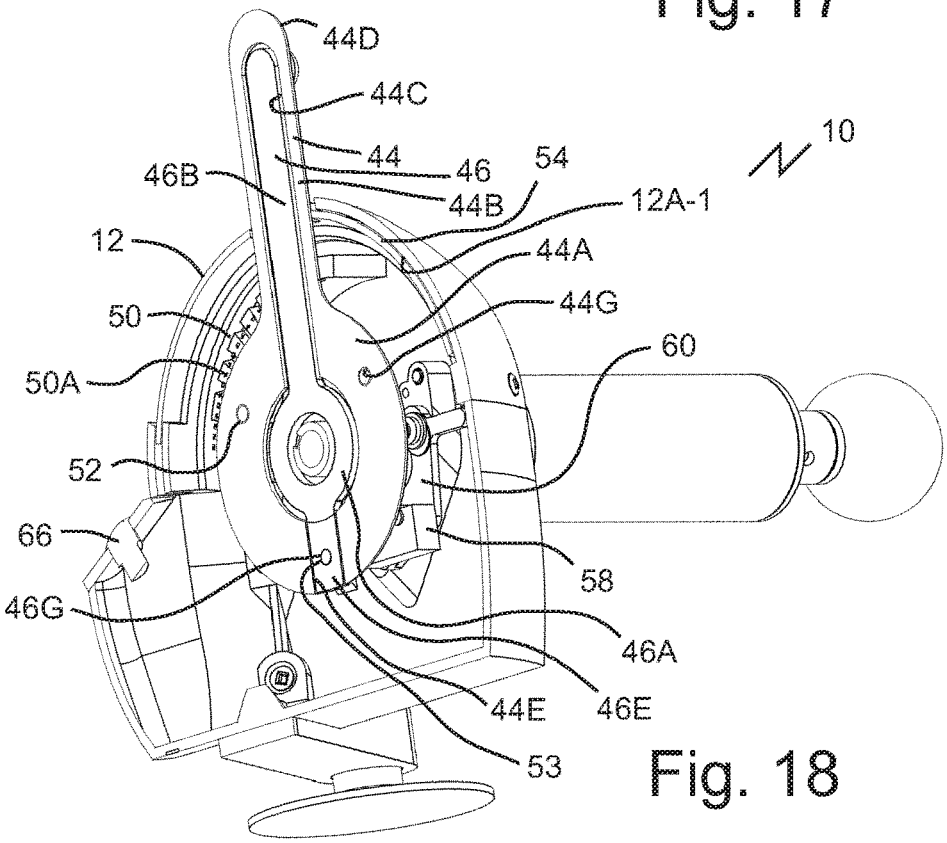
FIG. 18 is a perspective section view taken along the 18-18 section lines from FIG. 2.

Referring to FIG. 11, the lever lock 46 may be structured to resiliently bias the lock-arm-lever 46 away from the axial groove 44C, for example such that a gap 48 is defined between the lever 44 and lock lever 46 in the absence of an external force acting on the lever 46. When in the neutral position shown, lever lock 46 may resiliently bias the locking-tooth 46F into engagement with one groove of the plurality of teeth 50. Pressing the depressible button 46C toward the brake 18 may permit the lock-arm 46B to be pushed into the axial groove 44C and may concurrently disengage the locking-tooth 46F from a groove of the plurality of teeth 50, thus enabling rotation of the lever 44 and the lever lock 46 and adjustment of the resistance level. Following rotation of the lever 44 and the lever lock 46, the depressible button 46C may be released such that the lock-arm 46B returns to its original neutral configuration and the locking-tooth 46F engages a different groove of the plurality of teeth 50. Referring to FIGS. 9 and 18, lever lock 46 may have other suitable parts. A lock-hole 46G may be positioned to align with lever-base-hole 44F to receive a lever-handle-base-fastener 53, for example to facilitate mounting of lever lock 46 to lever 44.

Referring to FIGS. 9 and 11 the left and right shrouds 12A and 12B may be configured to protect the interior of the frame 12 from unwanted user access through a lever movement gap 12Q defined between the shrouds 12A and 12B. The arcuate strip 54 may be positioned about lever 44 within the gap 12Q. Each shroud 12A and 12B may have respective strip slots 12A-1 and 12B-1 for example shaped to receive arcuate strip 54 to permit strip 54 to slide through the slots 12A-1 and 12B-1 with the lever 44 during use. Arcuate strip 54 may have a strip-lever-hole 54A shaped to receive the lever 44 and the lever lock 46. As the lever 44 and lever lock 46 are moved along the arcuate path 50A, for example following disengagement of the locking-tooth 46F from a groove of the plurality of teeth 50 via pressing the depressible button 46C, the arcuate strip 54 may slide within the strip slots 12A-1 and 12B-1.

Referring to FIGS. 1 and 8, the FEPS device 10 may comprise interchangeable handles 20, for example to permit a user to perform a variety of unique motions and exercises. The FEPS device 10 may comprise a handle 20 connected to an end of the shaft 14, for example a first end 14A-2 or a second end 14A-3 of shaft 14. The FEPS device may comprise a plurality of handles 20, each handle 20 being distinct from one another and being configured to interchangeably connect to one or more of the first end 14A-2 and the second end 14A-3 of the shaft 14. The plurality of handles 20 may include a door knob 20', a door handle lever 20", a key 20'", any other suitable handle. In some cases a crank may be used, for example to provide a realistic motion for certain movements. Each handle 20 may connect to shaft 14 via a suitable mechanism, such as by mating with a corresponding stem 13C-1 of an end cap 13C. Caps 13C and handle 20 may connect via a suitable mechanism such as a locking pin and hole connection.

Referring to FIG. 8, the plurality of handles 20 may comprise a plurality of handle shafts 13D. Each handle shaft 13D may be distinct from one another and be configured to interchangeably connect to one or more of the first end 14A-2 and the second end 14A-3 of the shaft 14. Each handle shaft 13D may have a different diameter, or a different surface texture or structure. Each handle shaft 13D may connect to shaft 14 via a suitable mechanism, such as by mating with a corresponding end cap 13B. Caps 13B and shaft 14 may connect via a suitable mechanism such as a locking pin and hole connection.

Referring to FIG. 8, a plurality of handle tips 20A may be provided, for example each handle tip 20A being distinct from one another and being configured to interchangeably connect to an end of a respective handle shaft 13D. Referring to FIG. 8, the shaft 14 may comprise a spindle 14A, whose axial ends 14A-2 and 14A-3 may connect to handle tips 20A, handle shafts 13D, or another suitable intermediate structure.

Figure 19:
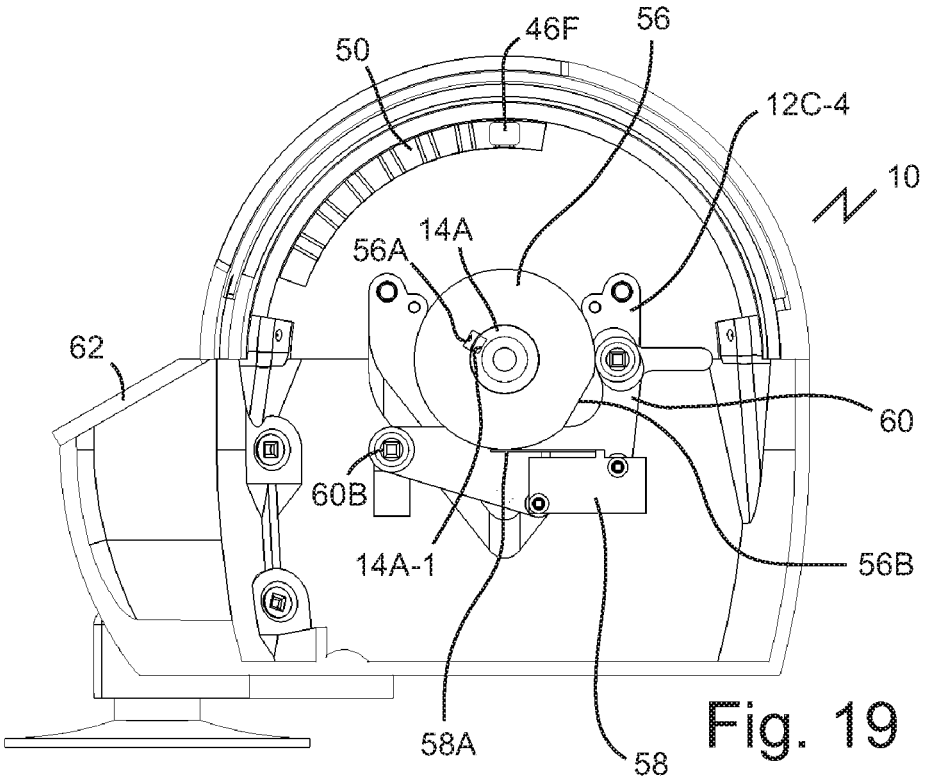
FIG. 19 is a section view taken along the 19-19 section lines from FIG. 2.
Figure 20:
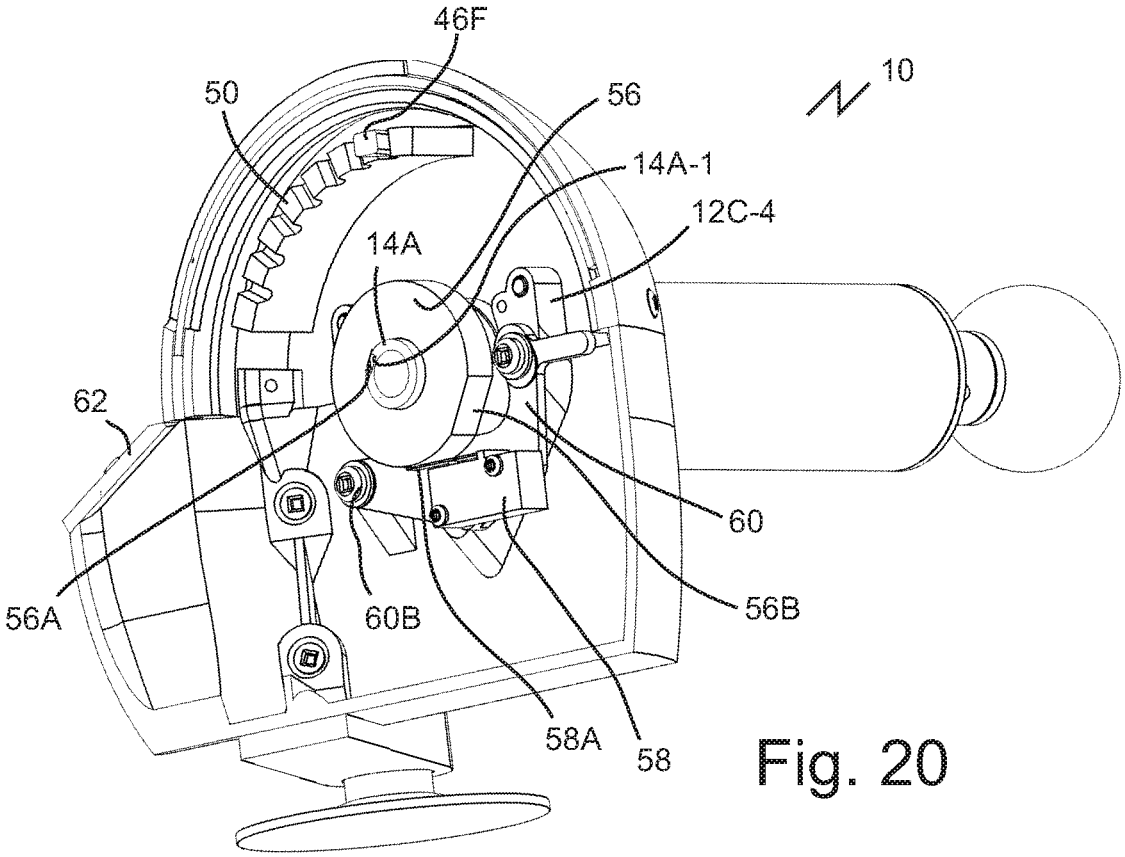
FIG. 20 is a perspective section view taken along the 20-20 section lines from FIG. 2.
Figure 21:
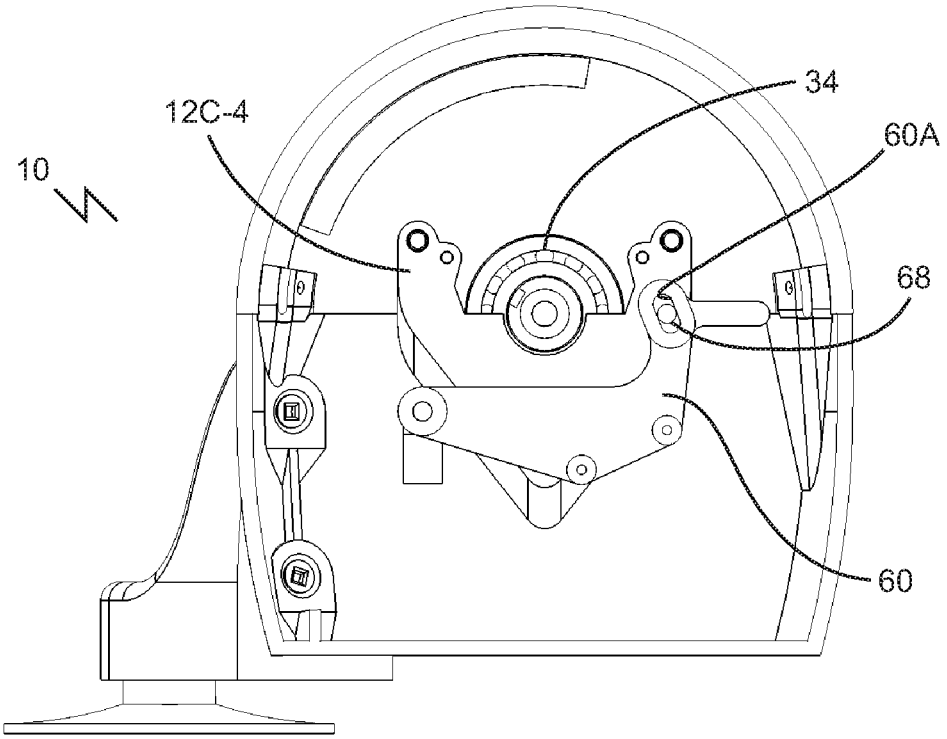
FIG. 21 is a section view taken along the 21-21 section lines from FIG. 2.
Figure 22:
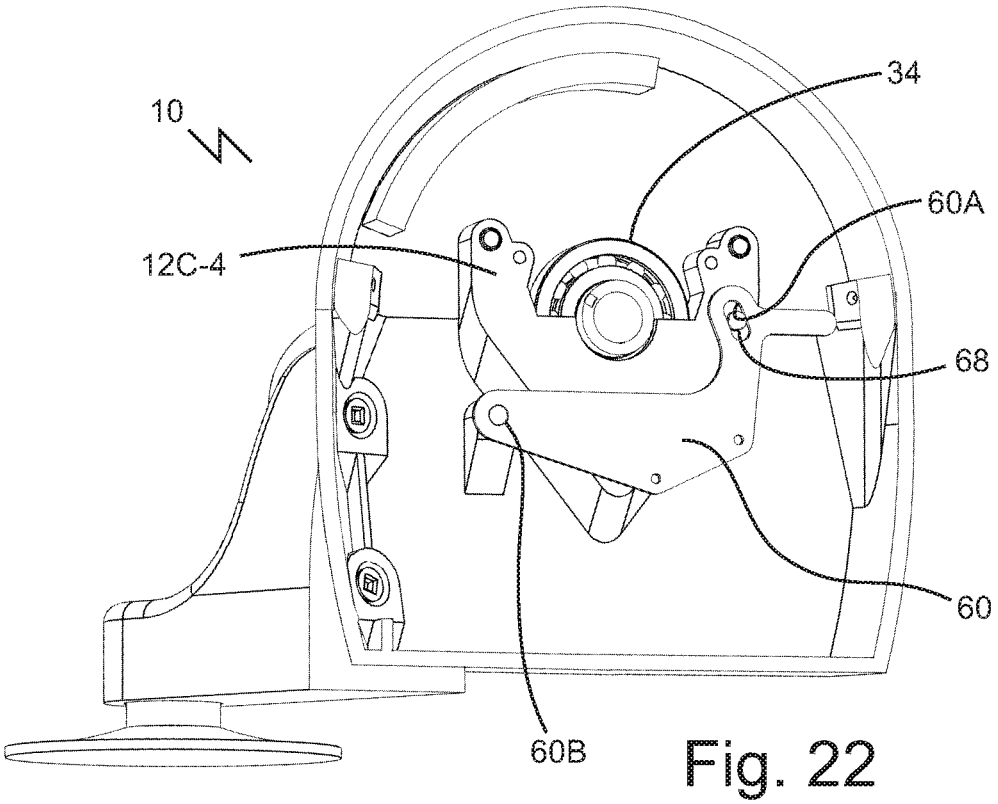
FIG. 22 is a section view taken along the 22-22 section lines from FIG. 2.

Referring to FIG. 20, the FEPS device 10 may comprise a repetition counter, for example to permit a user or therapist to keep track of progress during a rehabilitation routine. The repetition counter may comprise a shaft encoder 58. A rotary encoder, also called a shaft encoder, is an electro-mechanical device that converts the angular position or motion of a shaft or axle to an analog or digital code. The repetition counter may comprise a switch arm 58A mounted to follow an outer circumferential profile of a cam 56 mounted to the shaft 14. Referring to FIGS. 8 and 19-20, spindle 14A may have a spline slot 14A-1, which aligns with a slot 56A in cam 56 to receive a corresponding key such as a rod (not shown) to mount the cam 56 for torque transfer between the two parts. Referring to FIGS. 19-22, rotation of the shaft 14 causes cam 56 to rotate, and upon sufficient rotation a flat spot 56B of cam 56 contacts switch arm 58A. Encoder 58 may be mounted to pivot relative to frame 12, for example via mounting upon a bracket 60 that pivots about a pivot axle 60B. Bracket 60 may define a slot 60A that receives a limiter pin 68 extended from frame 12, for example from saddle 12C-4, to permit a limited range of pivoting motion of bracket 60 and hence encoder 58. The cam 56 may have a suitable shape, such as that of a ring plate with an out of round convex cross-sectional profile as shown.

Referring to FIGS. 12 and 20, upon arm 58A contacting flat spot 56B, the encoder 58 registers a count event and outputs a signal or displays an updated repetition count. In some cases the signal is sent for display on a display 64 on a face panel 62 mounted in frame 12. Suitable controls may be provided on face panel 62, such as an on/off or reset button 66. In some cases, resistance may be electronically adjusted from the face panel 62. A controller (not shown) may be provided to automate some or all of the functionality of the device 10.

Referring to FIGS. 1 and 8, one or both sides of shaft 14 may incorporate a manual counter or position indicator. In the example shown a protractor is positioned at each exit point for shaft 14 from frame 12. For example, referring to FIGS. 1 and 8, a pointer ring plate 36 is provided on shaft 14, with a pointer indicator 36A. The ring plate 38 rotates with shaft 14, and hence indicator 36A rotates about a protractor ring plate 38 to provide feedback to the patient or therapist as to the angular position of the handle 20. The ring plate 38 may secure to the frame 12 by a suitable method, such as by fastener holes 38B, which align with corresponding holes (not shown) in the frame 12 to receive fasteners 40.

Referring to FIG. 1, the FEPS device 10 may be used to perform a variety of flexion, extension, supination, and pronation exercises, for example to strengthen the user's forearms, wrist, hands and/or fingers. A user may perform flexion and/or extension exercises via the plurality of handle shafts 13D. A user may face a side of the FEPS device 10 and grip one or more handle shafts of the plurality of handle shafts 13D and rotate the handle shafts 13D in directions 22, for example in a direction 22A to perform a forearm extension exercise and/or in a direction 22B to perform a forearm flexion exercise. A user may perform supination and/or pronation exercises via the plurality of handles 20. The plurality of handles 20 may be common hand-manipulated objects such as door handles, knobs, and keys that permit the user to simulate everyday activities, for example as part of a rehabilitation program. The lever 44 and lock lever 46 may be used to increase or decrease the level of resistance provided by brake 18 against rotation of the shaft 14, and thus vary the difficulty of an exercise. Such parts may be used to increase forearm strength via progressive overload.

Fasteners include bolts, and other suitable parts that connect two other parts together. Holes include slots, gaps, and other structures that may be engaged by a fastener to secure two parts together. Parts of the device 10 may be constructed of suitable material, for example material that is medically safe, and resistant to degradation from hospital chemicals.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A FEPS (flexion extension pronation supination) device comprising:

a structural frame;

a shaft, having a longitudinal axis, wherein the shaft is mounted to rotate about the longitudinal axis relative to the structural frame;

first handles coaxially mounted on opposite ends of the shaft;

a brake adapted to apply a selectively variable resistance against rotation of the shaft;

a gripping member mounted to the structural frame and structured to adhere to an external support surface; and, a resistance adjuster lever connected to manipulate the brake;

wherein, the structural frame defines a plurality of teeth oriented about a range of motion of the resistance adjuster lever to selectively engage and disengage a corresponding tooth or indent on the resistance adjuster lever to set the brake at a desired resistance level.

2. The FEPS device of claim 1 in which the gripping member comprises a plurality of external-support-surface-gripping feet.

3. The FEPS device of claim 2 in which the gripping member comprises three external-support-surface-gripping feet.

4. The FEPS device of claim 1 in which the gripping member comprises a suction cup.

5. The FEPS device of claim 1 in which the brake comprises a magnetic hysteresis brake.

6. The FEPS device of claim 1 in which the resistance adjuster lever comprises an actuator connected to selectively disengage the corresponding tooth or indent with the plurality of teeth to permit the resistance adjuster lever to be moved into a different position about the range of motion.

7. The FEPS device of claim 1 further comprising a handle connected to an end of the shaft.

8. The FEPS device of claim 7 further comprising a plurality of second handles, each second handle being distinct from one another and being configured to interchangeably connect to the end of the shaft.

9. The FEPS device of claim 8 in which the plurality of second handles comprises:

a plurality of handle shafts, each handle shaft being distinct from one another and being configured to interchangeably connect to the end of the shaft; and a plurality of handle tips, each handle tip being distinct from one another and being configured to interchangeably connect to an end of a respective handle shaft.

10. The FEPS device of claim 1 further comprising a repetition counter.

11. The FEPS device of claim 10 in which the repetition counter comprises a switch arm mounted to follow an outer profile of a cam mounted to the shaft.

12. The FEPS device of claim 11 in which the cam comprises a ring plate with an out of round convex cross-sectional profile.

13. A method comprising operating the FEPS device of claim 1 by rotating the shaft.

14. A FEPS (flexion extension pronation supination) device comprising:

a structural frame;

a shaft, having a longitudinal axis, wherein the shaft is mounted to rotate about the longitudinal axis, relative to the structural frame;

first handles coaxially mounted on opposite ends of the shaft; and a magnetic hysteresis brake that is structured to apply a selectively variable resistance against rotation of the shaft relative to the structural frame.

15. The FEPS device of claim 14 further comprising a resistance adjuster lever connected to manipulate the brake.

16. The FEPS device of claim 15 in which the structural frame defines a plurality of teeth oriented about a range of motion of the resistance adjuster lever to selectively engage and disengage a corresponding tooth or indent on the resistance adjuster lever to set the resistance adjuster lever at a desired resistance level.

17. The FEPS device of claim 16 in which the resistance adjuster lever comprises an actuator connected to selectively disengage the corresponding tooth or indent with the plurality of teeth to permit the resistance adjuster lever to be moved into a different position about the range of motion.

18. The FEPS device of claim 14 further comprising a plurality of second handles, each second handle being distinct from one another and being configured to interchangeably connect to the end of the shaft.

19. The FEPS device of claim 18, wherein the plurality of second handles comprises:

a plurality of handle shafts, each handle shaft being distinct from one another and being configured to interchangeably connect to the end of the shaft; and a plurality of handle tips, each handle tip being distinct from one another and being configured to interchangeably connect to an end of a respective handle shaft.

* * * * *